United States Patent [19]

Gualchierani

[11] Patent Number: 4,817,373

[45] Date of Patent: Apr. 4, 1989

[54] APPARATUS FOR AUTOMATICALLY SUPPLYING CONTINUOUS SPINNING MACHINES WITH REELED MATERIAL

[75] Inventor: Sergio Gualchierani, Florence, Italy

[73] Assignee: Gualchierani System s.a.s. di Sergio Gualchierani & C., Florence, Italy

[21] Appl. No.: 33,341

[22] Filed: Mar. 31, 1987

[30] Foreign Application Priority Data

Apr. 3, 1986 [IT] Italy ..... 9363 A/86
Aug. 13, 1986 [IT] Italy ..... 9462 A/86

[51] Int. Cl.[4] ..... D01H 9/18; D01H 9/10

[52] U.S. Cl. ..... 57/281; 57/268; 57/276

[58] Field of Search ..... 57/266, 268, 276, 281

[56] References Cited

U.S. PATENT DOCUMENTS 4,438,622 3/1984 Pons ..... 57/281 X
4,583,358 4/1986 Krieger et al. ..... 57/281
4,586,326 5/1986 Igel ..... 57/281
4,630,435 12/1986 Igel ..... 57/281

*Primary Examiner*—John Petrakes
*Attorney, Agent, or Firm*—Hopgood, Calimafde, Kalil, Blaustein & Judlowe

[57] ABSTRACT

The apparatus is intended for automatically supplying continuous spinning machines (ring) with reeled material, in which the reels must be supported at a position above the work groups and hung downwards, and comprises in combination: in correspondence of the work groups, transfer and overturn units to move the reels-supporting mandrels upwards in order to receive the reels and downwards to arrange the reels mounted thereon in a supply attitude; a transfer or conveyor system for periodically bringing a transfer or conveyor carriage into positions corresponding to those of the mandrels for the replacement of the reels; and means for transferring the reels from the carriage to the upwardly turned mandrels.

16 Claims, 15 Drawing Sheets

APPARATUS FOR AUTOMATICALLY SUPPLYING CONTINUOUS SPINNING MACHINES WITH REELED MATERIAL

DESCRIPTION

The invention refers to an apparatus which allows the automatic and rapid supply of continuous spinning machines with reeled material which must be treated by the work groups of the continuous or so-called ring spinner in order to obtain the yarn. The continuous or ring spinners are developed over very elevated lengths, comprise work groups normally located on two opposite rows and require the supply of the material to be spun located above the individual groups. The material is fed by reels coming from previous processes of the material to be spun, which reels must be located in correspondence with the individual work groups or, more often, disposed on alignments transversal to the fronts, that is, to the rows of the spinner work groups, so that more reels (usually two or three) placed perpendicular to a work front are of use to supply underlying adjacent work groups.

The invention has the object to avoid the manual intervention and the remarkable stop time which weights as a dead time over the work cost, by achieving a continuous reels supply, location by location. Generally, this operation is performed by stopping the machine and providing for the manual withdrawal of the empty (run out of material) tubes and the loading of the reels. The reeled material is brought near the head of the continuous spinner or is brought along the front or each front of the continuous spinner by means of carriages which carry the reels in more layers of axially, that is, vertically aligned reels.

The invention allows the operation to be carried out with substantial automation.

Substantially, an apparatus for the supply of continuous spinning machines (ring) with material in reels which must be supported in a position above the work groups and hung downwards, comprises in combination: in correspondence with the work groups, transfer and overturn units to move the reels supporting mandrels upwards to receive the reels, and downwards to position the reels mounted thereon in the delivery attitude; a transfer system for periodically moving a transfer carriage into positions corresponding to those of the mandrels for the reels replacement; and means for transferring the reels from the carriage to the upwardly turned mandrels. Said carriage is also able to withdraw the empty tubes of the reeled off reels from the mandrels and place them in bulk inside suitable containers.

Advantageously, the transfer carriage of the reels is provided with means for the lowering and lifting of downwardly turned mandrels, said means being able to engage the reels to be distributed, to hand over the reels to the mandrels of the transfer and overturn units and to withdraw the empty tubes of the reeled off reels from said units.

According to a practical embodiment, the individual transfer and overturn units comprise flexible continuous means—like belts, chains or other elements being driven to define an upper branch and a lower branch, on each of which, mandrels may be found in any attitude turned upwards and respectively downwards; said flexible means being oriented orthogonal to the work front of the spinner and apt to be operated through an intermittent motion.

Generally, the apparatus comprises, on at least a spinner end, a withdrawal station from at least a carriage container; means being provided for transferring the reels from the carriage container to the mandrels of the transfer carriage; and means on the carriage for the previous discharge of tubes of the reeled off reels, picked up at individual work positions.

According to a development of the invention, an apparatus for supplying continuous spinning machines (ring) with reeled material, in which the reels must be supported above the work groups and hung downwards, comprises: in correspondence of the work groups, transfer and overturn units for moving the reels supporting and retaining mandrels upwards in order to receive the reels and donwards to position the reels mounted thereon in the supply attitude; a transfer system for periodically bringing a transfer carriage into positions corresponding to those of the mandrels to replace the reels; on the carriage, means for witwdrawing the empty cores or tubes of the reeled-off reels from the upwardly turned mandrels of said transfer and overturn units, and dumping them in bulk into suitable containers, as well as means to pick up the full reels for the replacement of the reeled-off ones and transfer them to said mandrels of said units; at least at one end of the spinning machine, a station for the withdrawal of the full reels from at least a carriage container; as well as means connected to a programming device, or other, able to position the reels transfer carriage with the means for picking up the reels being disposed in coaxial arrangement in respect to the reels tidily loaded inside the transfer carriage and to define the lowering and lifting run of said means, or the lifting of the transfer carriage bottom as well; in said apparatus, the mandrels are rods fixed for their free rotation to the transfer and overturn units, and expansion and disappearance flyers are articulated on the end of said rods and able to retain the tubes of the reels being positioned in a downwardly turned supply attitude.

Advantageously, according to the invention, the transfer carriage comprises members with means able to determine and maintain the disappearance of said flyers inside the rod, as well as means to seize, lift and guide the empty tubes carried by the mandrels turned upwards by the transfer and overturn units.

According to a further development of the invention, an apparatus for a plant supplying continuous spinners with reeled material comprises in combination: a carriage means sliding from below upwards, with horizontal support bars able to receive the reels fed one at a time from a belt conveyor located downstream of the reels forming machine, on which the reels advance in axial alignment; on said carriage means, and combined therewith, means for rotating the reel in order to compact its outer layer and entrap the end of the last turn, by causing said layer to slide in contact with the support bars; a unit, articulated on said carriage means, including the support bars and able to retain the reel between the support bars and fixed bars vertically projecting from the fixed part of the carriage means, as a result of a 90° rotation of said unit, thereby the reel places itself with vertical axis; means for lifting overhead said carriage means with the unit being rotated; a horizontally translating carriage equipped with means for the reel centering and with vertically moving jaw means able to pick up the vertically disposed reel and to release it afterwards, said carriage performing, after a displacement in the horizontal direction, the placement of the reel, thus picked up, one at a time inside, one of the cup containers of a conveyor made up of a chain of cylindrical vertical upwardly opened cups and which moves step-by-step overhead, that is at a certain height transversally to the spinner axis and in the zone in front of the spinner head, and which presents the cups with the reels held therein, at such a height and with such a disposition as to be able to be picked up by the carriage that feeds the reels to the spinner; a belt conveyor being also provided in said zone in front of the spinner head in order to collect and move away the empty tubes of the reeled off reels, picked up by the feeding carriage and then released thereby.

Advantageously, the means for rotating the reel comprise a tailstock which goes into the hole of the reel core, moving back afterwards to let the reel turn through 90° together with said unit.

According to a further advantageous feature, the cups chain conveyor forms a closed ring, mostly polygonal, while the horizontally translating carriage moves, to dump the reel, perpendicularly to a side of the ring, and the spinner axis is perpendicular to another side of the ring.

According to a practical embodiment, the cups chain conveyor is in the form of a rectangular ring and the plant may comprise more polygonal conveyors, especially rectangular, concentrically disposed one inside the other for feeding a plurality of spinners having their axes parallel one to the other.

The invention will be better understood by following the description and the attached drawings, which show a practical, non limitative exemplification of the same invention. In the drawings.

Figure 17:
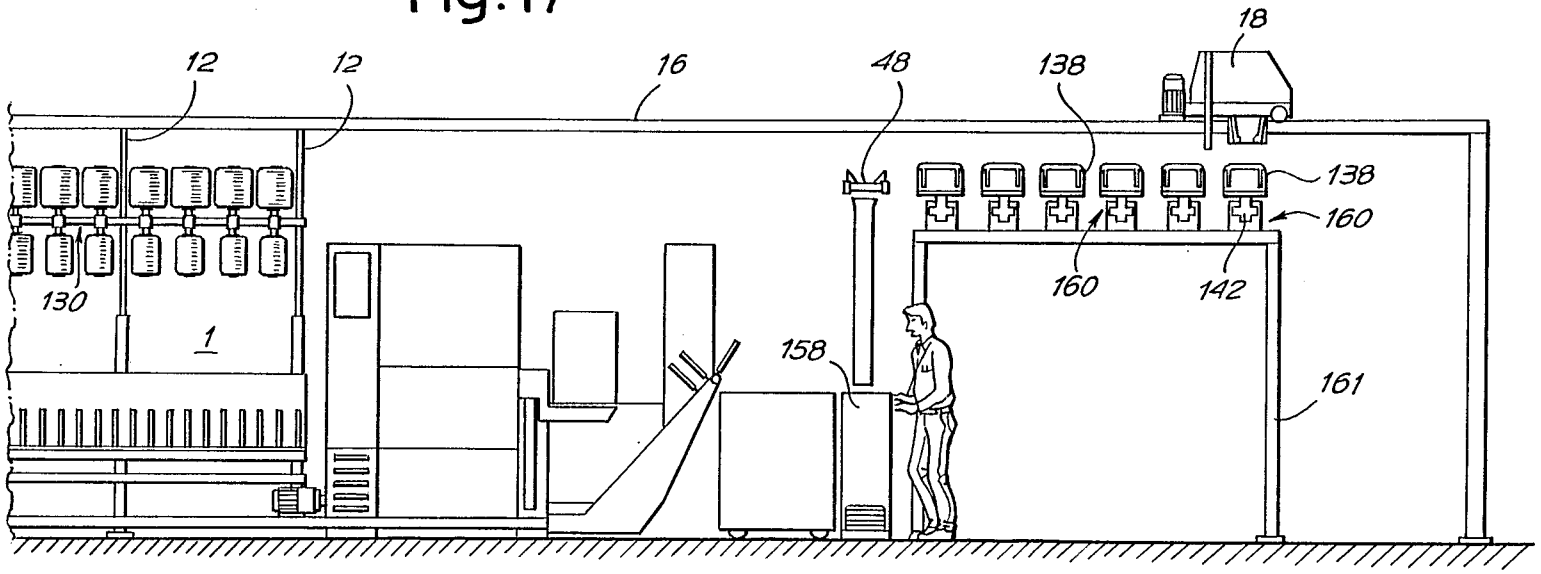
Figure 18:
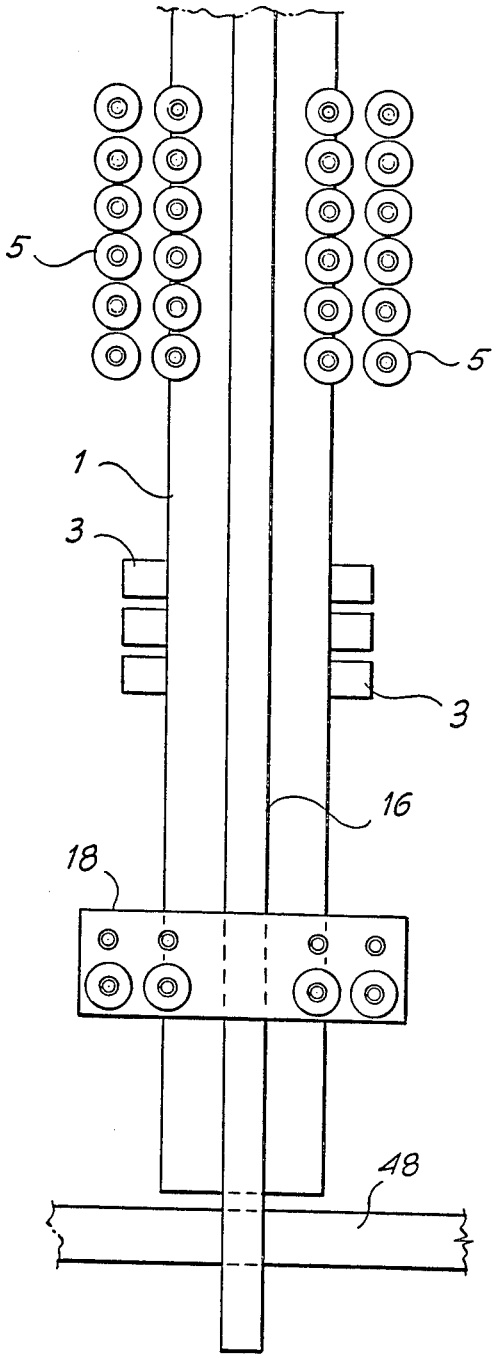
Figure 19:
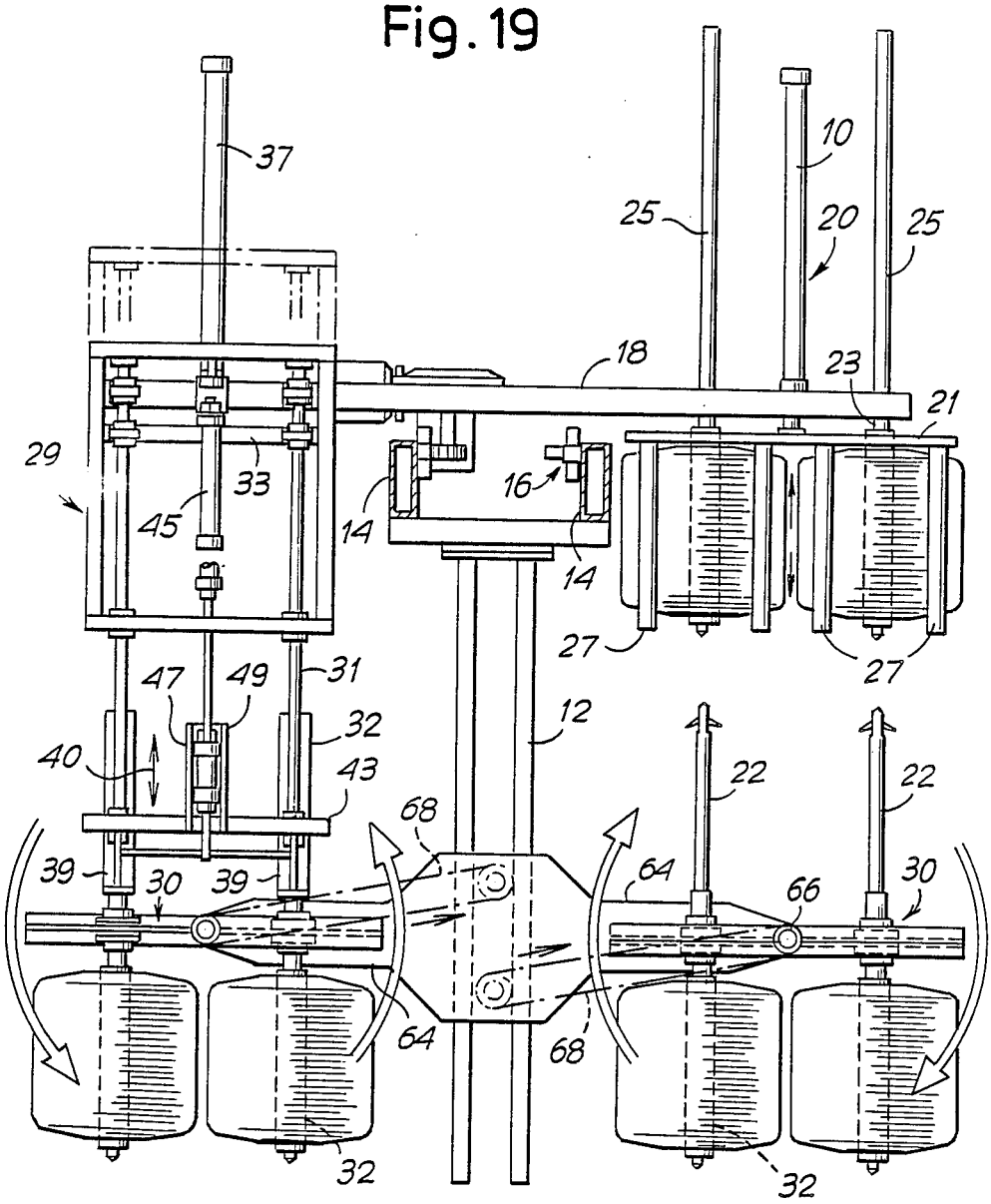
Figure 20:
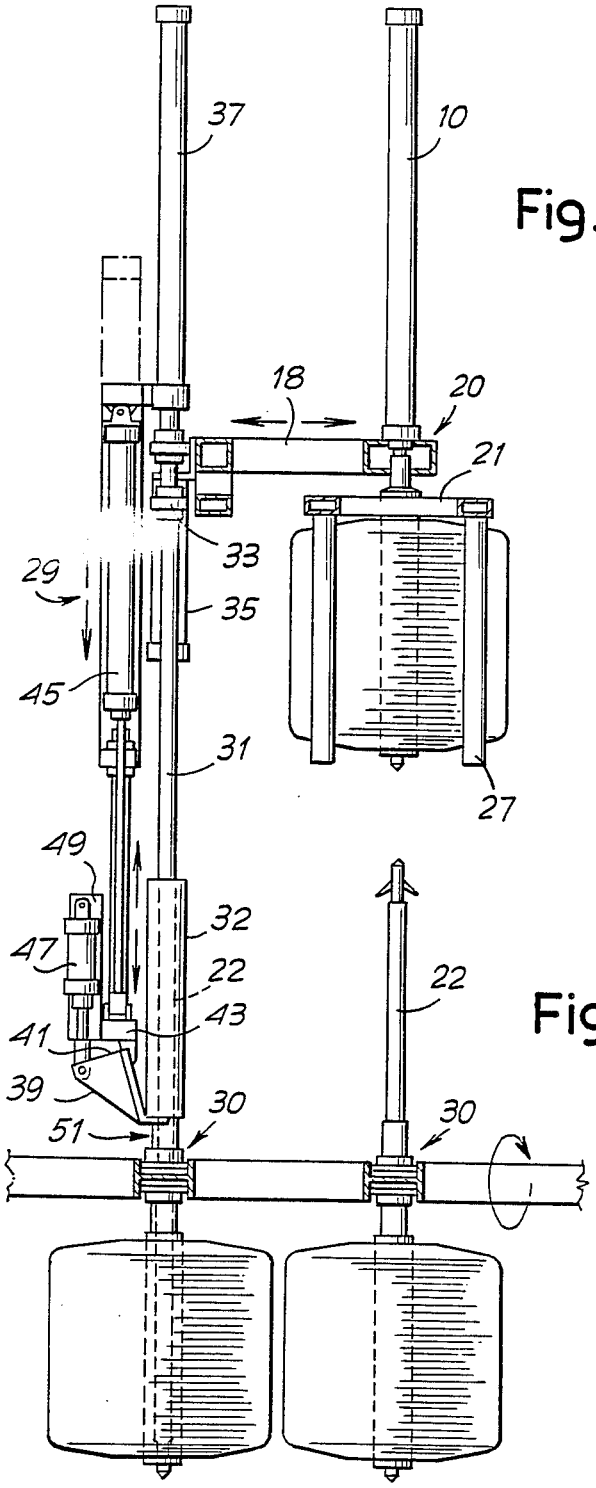
Figure 21:
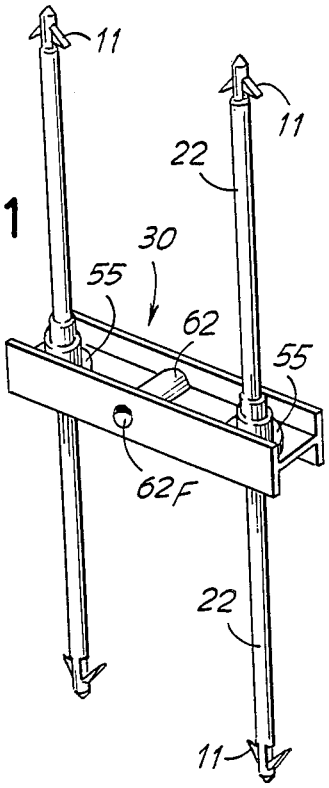
Figure 22:
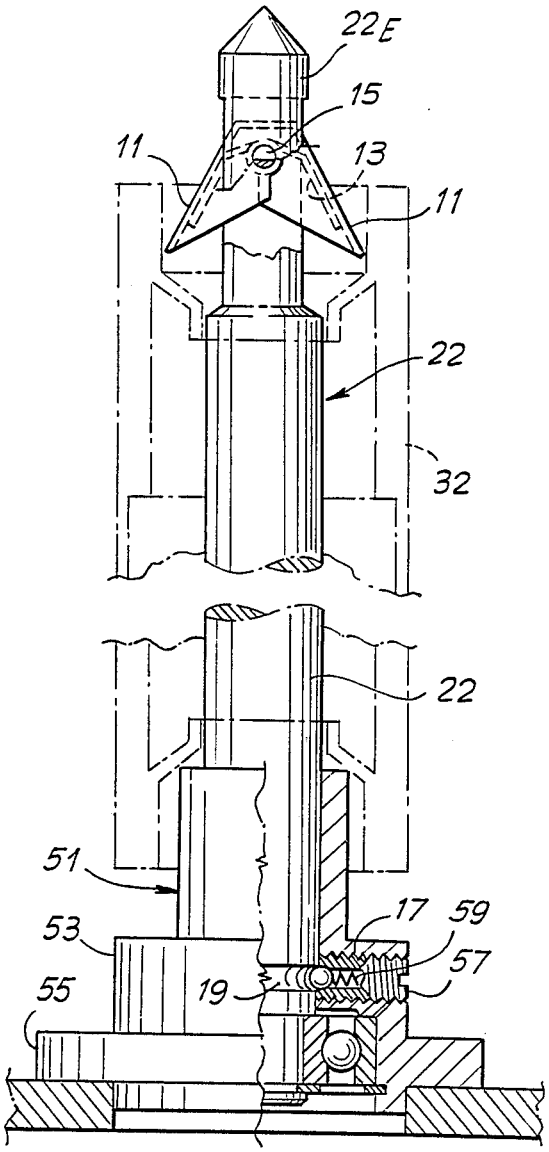
Figure 23:
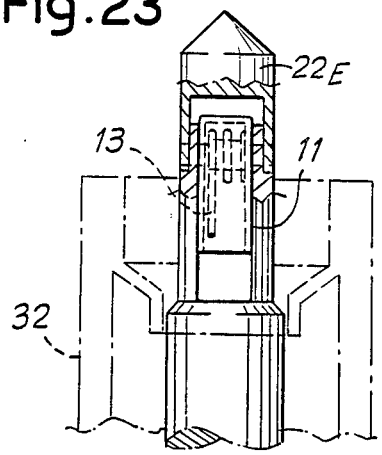
Figure 24:
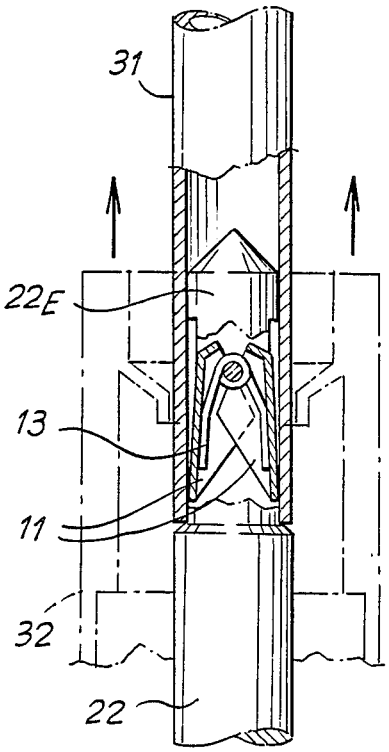

FIGS. 17 and 18 schematically illustrate the system for transferring the reels from the cup conveyors to a spinner;

FIGS. 19 and 20 show, respectively, front and side views of the carriage means for the transfer of the reels to the spinner, and of a member for the conveyance and overturning of the reels;

FIG. 21 shows a schematic perspective view of a conveyance and overturning member; and FIGS. 22, 23 and 24 show the means for retaining the reel tubes on the mandrels and disengaging them therefrom.

Figure 1:
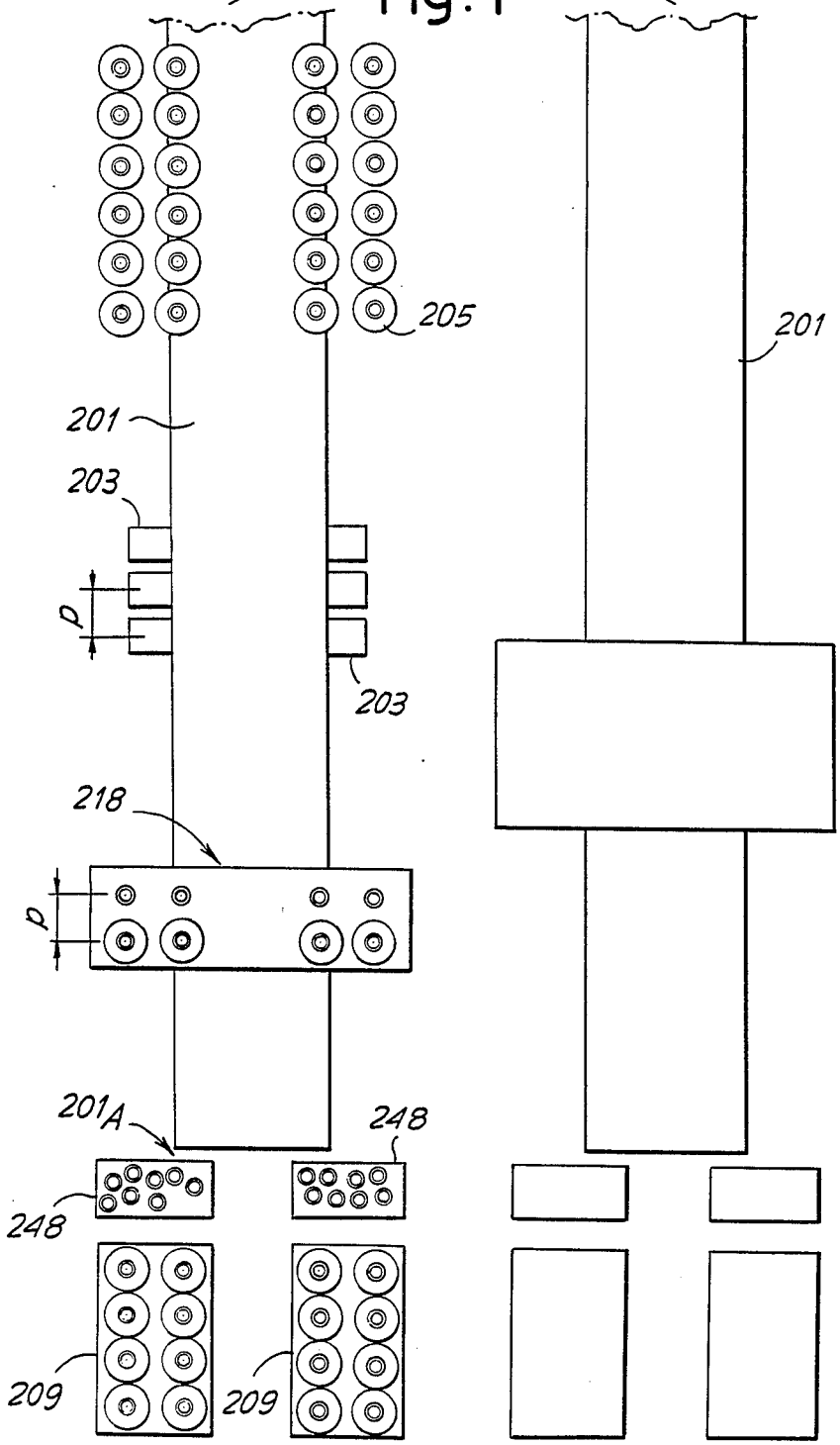
FIG. 1 shows a schematic plan view of a portion of two adjacent continuous spinning machines and of the relative reels supply stations.
Figure 2:
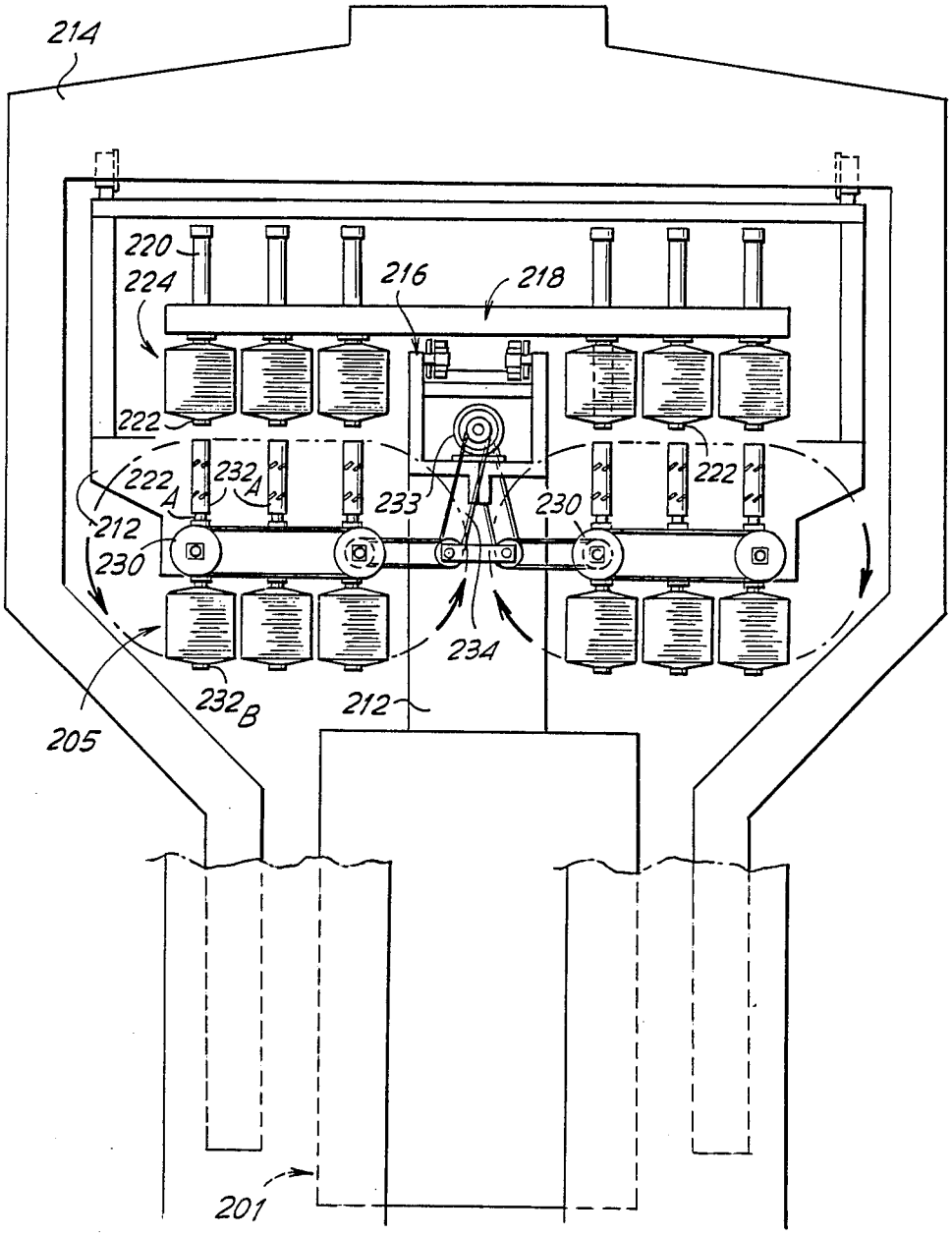
FIG. 2 shows a schematic view of the apparatus according to the invention.

According to what is illustrated in FIGS. 1 and 2, numeral 201 indicates two continuous spinners, or ring, developing over considerable lengths (for example 25 meters for 400 spindles) and each having two work fronts (200 spindles on the right and 200 on the left), that is, two work groups (also called draft groups), generally indicated by 203, the center distance of which is indicated by P. Above the work (that is, draft) groups of the two rows, support means for reels 205 intended to supply the individual groups 203 are provided; the reels must be suspended from above to allow the easy unwinding of the tape-like, that is, roving material from the reels towards the underlying work groups 203. In FIG. 1 transverse alignments of reels are provided, and in each of these alignments two side-by-side reels are provided in correspondence of each of the two opposite work fronts; in FIG. 2, instead, three reels 205 are provided disposed according to the transverse alignments. Alternatively, other equivalent arrangements may be provided in the continuous spinners. The assembly of a continuous spinning machine is generally and very summarily indicated by the longitudinal structure 1 and by the work groups 203, the spinners being of any known type.

In FIG. 1, 201A indicates one end of the spinner 201 where two carriage containers 209 may be located, whose reels layers have the reels substantially lined up with the positions of the reels 205 placed on the spinner. However, it is not excluded that the positioning of carriage containers 209 may be different in respect to the alignment of the reels 205 placed on the spinner. Moreover, a container 248 is located on the forefront of the spinner for the collection of the empty tubes.

The apparatus according to the invention allows an automatic withdrawal of the reels from the carriage containers 209 and the positioning of the same into the positions 205 that the reels must take up for the supply of the spinning groups 203, as well as the automatic withdrawal of the empty tubes (or cores) 232A from the spinner and their storage inside the container 248.

This apparatus, schematically illustrated in FIG. 2, comprises, above the very spinner 201, a housing generally indicated by 212 with outer bridge-like frames 214 which support guide means 216 for a carriage 218, which can be moved along the spinner 201 and projects from opposite sides in respect to the two rows of the work groups 203. The carriage 218, has according to the drawing, four transverse rows of drive systems 220 which serve to determine an axial vertical movement of the support mandrels 222 intended to receive the reels to be replaced while keeping them downwardly suspended as well as to receive the tubes or cores to be moved away. In FIG. 2 each row comprises two terns of reels 224 and in FIG. 1 each transverse row has two pairs of mandrels 222 and thus of reels 224 to be supplied to the spinner, and respectively of tubes to be moved away. The carriage 218 is moved along guide means 216 in a substantially automated manner, with the possibility of being programmed according to the positions in which the reels have to be replaced on the spinner. The carriage 218 is also moved every time—to perform an operation—as far as above the carriage containers 209, so as to discharge the empty tubes into the container 248 and be able to withdraw, from the container 209 the reels to be brought onto the spinner in place of those reeled off. The arrangement of the rows of mandrels 222 is such as to consent the withdrawal of reels from the carriage containers 209; a disposition may also be provided allowing the alignment of the reels to be withdrawn with the mandrels 222 which are to receive them and transfer them onto the spinner. In any case, the carriage 218 is able to simultaneously pick up, according to FIG. 1, eight reels to be replaced and, according to FIG. 2, six or twelve reels, depending on whether two or four transverse rows of mandrels 222 are present on the carriage 218. In any case the number of reels picked up by the carriage through the mandrels 222 is equal to half the number of mandrels as the carriage must provide firstly for the withdrawal of the empty, or almost empty tubes from a location in which the replacement has to take place, and successively must place, in the spinner at said location, the new reels picked up and transferred by the same carriage.

In correspondence of the positions at which the reels 205 must find themselves ready to deliver the material to the spinning groups 203, transfer and overturn units are provided to move the reels supporting mandrels from an upwards position to receive the reels from the carriage 218, that is from the mandrels 222, up to a downwards position in the supply attitude of reels 205. To this end, in correspondence of each transverse alignment or of one group of alignments of reels 205, chain or similar continuous conveyors 230 are provided, developed with their upper and lower branches orthogonal to the fronts of the work groups 203; on the continuous conveyors 230, mandrels 222 are mounted (on which the reels 224 with the tubes 232A and 232B are arranged) in two groups that in FIG. 2 consist each of three mandrels, the mandrels 222A being represented upwardly turned and ready to receive a reel 224, while those indicated by 222B are at the position downwards turned to support the reels 205 in the attitude to deliver material to the work groups. When a set of reels 205 has run out of material, or is about to be completely reeled off, it is necessary to provide for the reels supply, that is, for the replacement of the reels in the work groups; to this end, the carriage 218 is brought with the reels 224 into alignment with and above to the the mandrels 222A, so as to operate through transfer systems 220 to lower the reels 224 and insert them onto said mandrels 222A. Soon after, the conveyor 230 is given a command to move the mandrels 222A, with the new reels transferred thereon, up to the position 222B and to transfer the mandrels 222B upwards with the empty or almost empty tubes (or cores) to the position previously taken by the mandrels 222A; at this point, the carriage 218 is limitedly moved and further withdrawal groups, similar to those indicated by 220, are operated to engage the empty tubes and lift them in order to release the mandrels that are now at position 222A, thereby putting them in a condition to receive the reels for a further loading operation. The withdrawal of the empty tubes may be carried out any time during the material delivery from the reels that are at the position 205, and not necessarily immediately after the replacement of the reels. The picked up empty tubes are suitably moved away during the displacements of the carriage 218, to be stacked up in bulk inside the container 248 and reutilized in further work processes.

In order to operate the transverse conveyors 230, a central control may be provided with a motor like that indicated by 233 and a transmission 234, to determine the simultaneous drive of the conveyors 230 located at opposite sides of the spinner, for the replacement of thc reels on the two work fronts.

Obviously, after the replacement of one group of transversally aligned reels, there is performed a withdrawal of the reels from the carriage containers 209 by moving the carriage 218 again towards and beyond the end 201A of the spinner, in order to carry out the withdrawal both by utilizing the systems 220 of the carriage, and providing an upwards displacement of the bottoms of containers 209 for the transfer of the reels from the containers to the withdrawal mandrels 222. By a suitable programming it will be possible to establish the positions of the reels carrying carriages, of the containers for the empty tubes as well as the vertical displacement run to obtain the reels withdrawal according to the level at which the residual stored reels are in the containers 209. By suitable programming systems (timers, electronic limit switches, or other) it will be possible to establish the run and the position that the carriage 218 has to take up for a replacement of the reels, as well as the rotation of the mandrels with the reels inserted thereon in order to bring the same reels from the upper position to the lower vertical one, through a call determined by the work groups that have been stopped for lack of material to be spun or through an operator's manual operation. Though a simultaneous running out of the material in all the reels of one or two transverse alignments above the work groups 203 is not rigidly foreseeable, however it is possible to foresee, on the other hand, that the reels previously replaced by a simultaneous operation along one or two transverse alignments may tend to run out of material all at the same time or nearly at the same time, thereby the replacement of one group of reels does not necessarily lead to a significant loss of material to be spun which, however, can be recovered on a subsequent work process.

Figure 3:
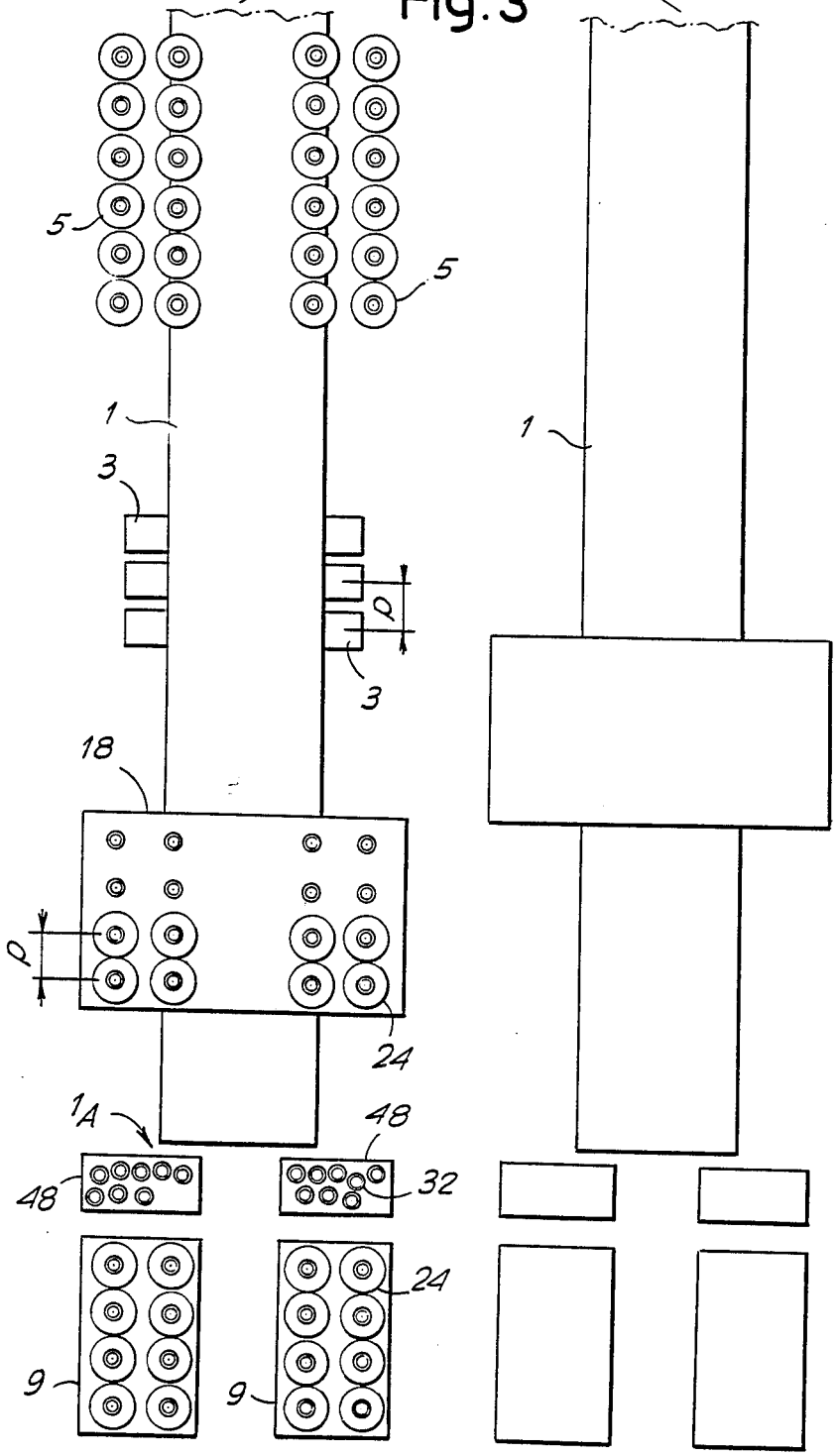
FIG. 3 shows a plan view of a portion of two adjacent continuous spinning machines and relative reels supplying stations.

According to what is illustrated in FIGS. 3 through 10, numeral 1 indicates two continuous spinning machines or rings, which develop over significant lengths (for example, 25 meters for 400 spindles) and each having two work fronts (200 spindles on the right and 200 on the left), that is, two rows of work groups (also called draft groups) generally indicated by 3, the center distance between them being indicated by P. Above the work (draft) groups of the two rows, means are disposed for supporting reels 5 intended to supply the individual groups 3; The reels must be suspended from above in order to allow an easy unwinding of the tape-like, that is, rove-type material, from the reels towards the underlying work groups 3. FIG. 3 shows transverse alignments of reels where each alignment is provided with two side-by-side reels in correspondence of each of the two opposite fronts of the work groups. Alternatively, other equivalent arrangements may be provided in the continuous spinning machines. The assembly of a continuous spinning machine is generically and quite summarily indicated by the longitudinal structure 1 and work groups 3, the machines being of any known type.

In FIG. 3, 1A indicates one end of the spinner 1 on which two carriage containers 9 may be located, whose reel layers have the reels substantially lined up with the positions of the reels 5 placed on the spinner. It is not excluded that the positioning of the carriage containers 9 may be different from the alignment of the reels 5 placed on the spinner. Moreover, a pair of containers 48 for the collection of the reels empty tubes (or empty cores) is located in the forefront of the spinner.

Figure 10:
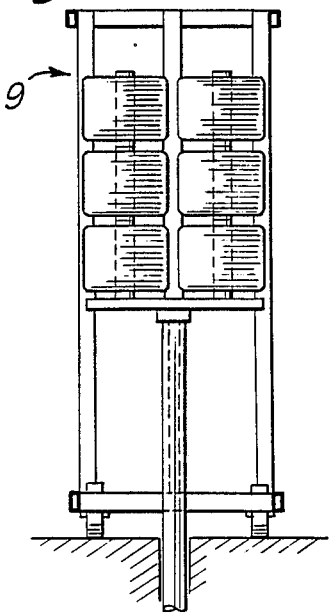
FIG. 10 shows schematically the system for the lifting of layers of reels kept within a carriage container for the supply of a spinning machine.

The apparatus for the automatic withdrawal of the reels from the carriage containers 9 and the placement of same reels at the positions that the reels 5 must take up for the supply of the spinning groups 3, as well as the automatic withdrawal of the empty tubes (or cores) 32 from the spinner and their storage inside the containers 48 are now illustrated. This apparatus, diagrammatically illustrated in FIG. 4, comprises, above the very spinner 1, a frame generally indicated by 12, with longitudinal beams 14 supporting guide means 16 for a carriage 18 which can be displaced along the spinner 1 and projects from opposite sides in respect to the two rows of work groups 3. The carriage 18 has one or more drive systems 20 for causing an axial vertical movement of reels 24 picked up from the carriage containers 9 and intended to be handed over to the support mandrels 22 of suitable overturn units 30 (to be described later); the mandrels 22 are intended for receiving the reels to be replaced and, after the overturn, keeping them suspended downwards for the regular unreeling of the rove upon the spinning operation. The drive system 20 (in the drawing) is made up of a cylinder-piston system 10 to the rod of which a transverse member 21 is fixed being provided with guide rods 23 sliding within tubular guides 25. The member 21 has lower jaw means 27 articulated thereto and driven by fluid means (or otherwise), said jaw means being apt to withdraw the reels 24 from the carriage containers 9 and open to release them once their core (or tube) has slipped on an upwards turned mandrel 22 of a unit 30 owing to the lowering of the member 21. The downwards run of the member 21 is fixed (in the example of the drawing) and, since the reels are arranged in different layers inside the carriage containers 9, a lifting motion of the bottom of said containers is provided as one of the layers of reels is gradually exhausted (that is, run out of material) (FIG. 10).

Figure 7:
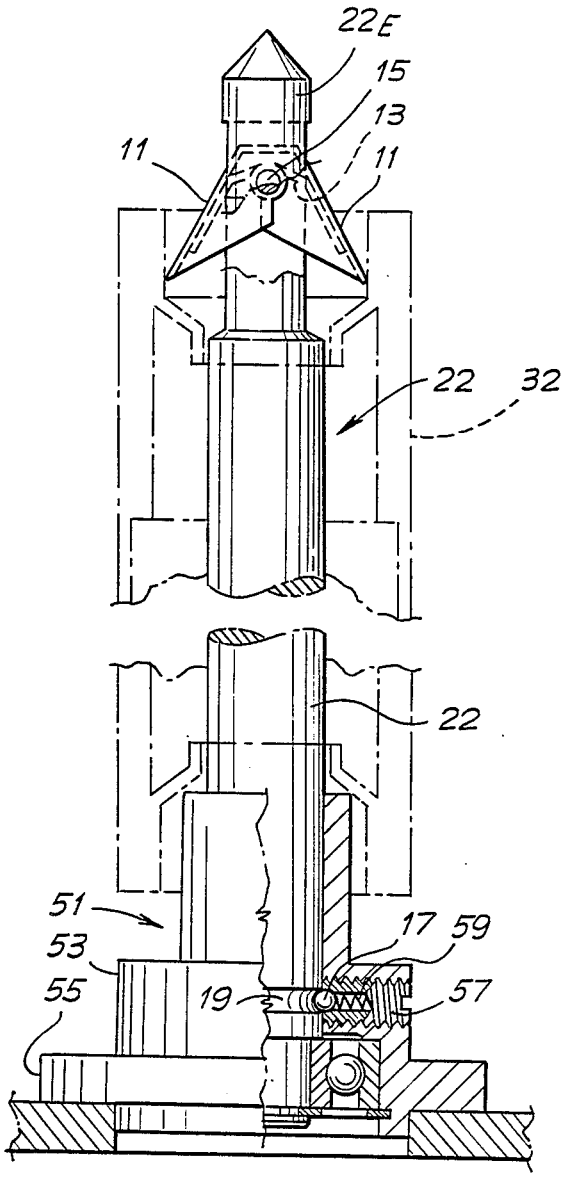
FIGS. 7, 8 and 9 are schematic views: of a mandrel able to receive a core, or tube, of a reel; of the members for retaining said core and of the operation procedures allowing the withdrawal of an empty core from the mandrel.

As shown in FIG. 7, each mandrel 22, on which a tube 32 can be inserted for rotating a solid therewith, has a pair of expansion flyers 11 at its end 22E (of reduced diameter) that are articulated in 15 and kept spaced apart by a helical spring 13, which flyers retain the tube 32 and the reel wound thereon, when the mandrel, owing to a unit 30, finds itself turned, that is, overturned downwards in working position. The cross section of a mandrel 22 exhibits shapings for the correct centering and solid rotation of the tube 32 inserted thereon, while the rotation of the same mandrel, obtained through a roll bearing, may be slightly slowed down by the adjustable pressure action of a ball 17 upon the surface of an annular groove 19. The flyers 11, in their normal expansion position, prevent also the coming out of a tube 32 which is to be picked up by a mandrel 22 after the reel supported by the same tube has been reeled off and after the mandrel 22 of such reel has been brought into a vertical upward position owing to the relevant overturn unit 30. For the withdrawal of the empty tubes 32 from mandrels 22, the carriage 18 is provided with assemblies 29 (two in the example of the drawing) performing the release and withdrawal of the empty tubes 32. The assemblies 29 provide for the withdrawal of the empty tubes when the carriage 18 is above the overturn unit of a work group, for retaining them during the translation of the carriage as far as above the containers 48 and letting them drop inside the latter.

Figure 8:
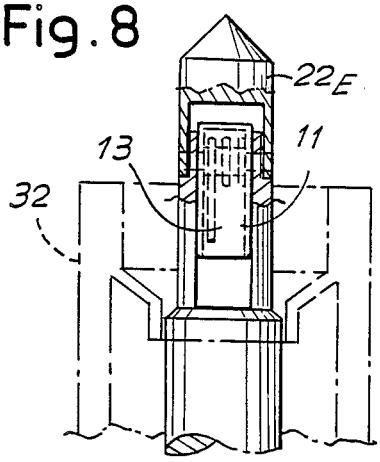
Figure 9:
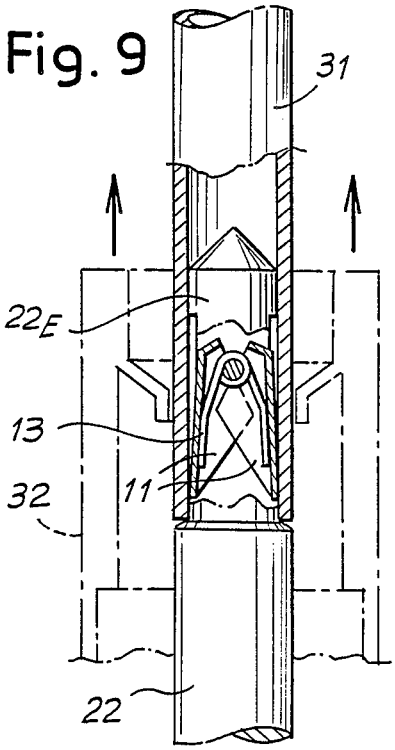

Characteristically, according to the invention, each assembly 29 comprises tubular rods 31, whose inner diameter is nearly equal to that of the end 22E (of reduced diameter) of the mandrel 22, from which the flyers 11 project; the outer diameter of the tubular rods 31 is nearly equal to that of the rod of mandrel 22. The tubular rods 31 are in vertical position and, when the carriage 18 is at the position for the withdrawal of the empty tubes, they are coaxial with the underlying mandrels 22. The rods 31 are fixed to a member 33 which slides within the guides of a frame 35; a cylinder-piston system 37 pushes the member 33 downwards so that the end of each tubular rod 31 comes to be inserted on the end 22E of each mandrel 22, thus causing the "disappearance" of the flyers 11, as shown in detail in FIG. 9. FIGS. 7, 8 and 9 show also how the flyers 11 are made hollow in their lower part in order to make said retraction movement (or disappearance) possible, same movement taking place upon winning the counter action of the spring 13. When the rods 31 have been inserted on the ends 22E of mandrels 22, a condition of continuity is practically realized between the surfaces of said rods and said mandrels and it is then possible to withdraw the empty tubes 32. To perform said withdrawal, each assembly 29 is provided with jaw members 39 articulated at 41 to a crosspiece 43 of a member 40 which is vertically movable upwards and downwards, according to the double arrow f40, by means of a cylinder-piston system 45. The downwards movements of members 39 are performed when the latter are in "open" position and, therefore, away from the outer surface of a tube 32. For the withdrawal of the tubes, following the lowering phase, the jaw members 39 are moved into their closing position, shown in FIG. 5, by the action of a cylinder-piston system 47 secured to an appendix 49 which projects upwards starting from the centre of the crosspiece 43. The flat grip portion of each jaw member 39 is made to enter the recess 51 in order to seize a tube, which recess in the usage conditions is present between the lower end of a tube 32 and a hub 53 of a flanged base 55 wherein the support and thrust bearing is housed for the rotation of each mandrel 22 (FIG. 7). It will be seen that inside the hub 53 a radial screw and a spring 59 are placed to adjust the braking pressure exerted by the ball 17 on the surface of the annular grove 19.

Figure 4:
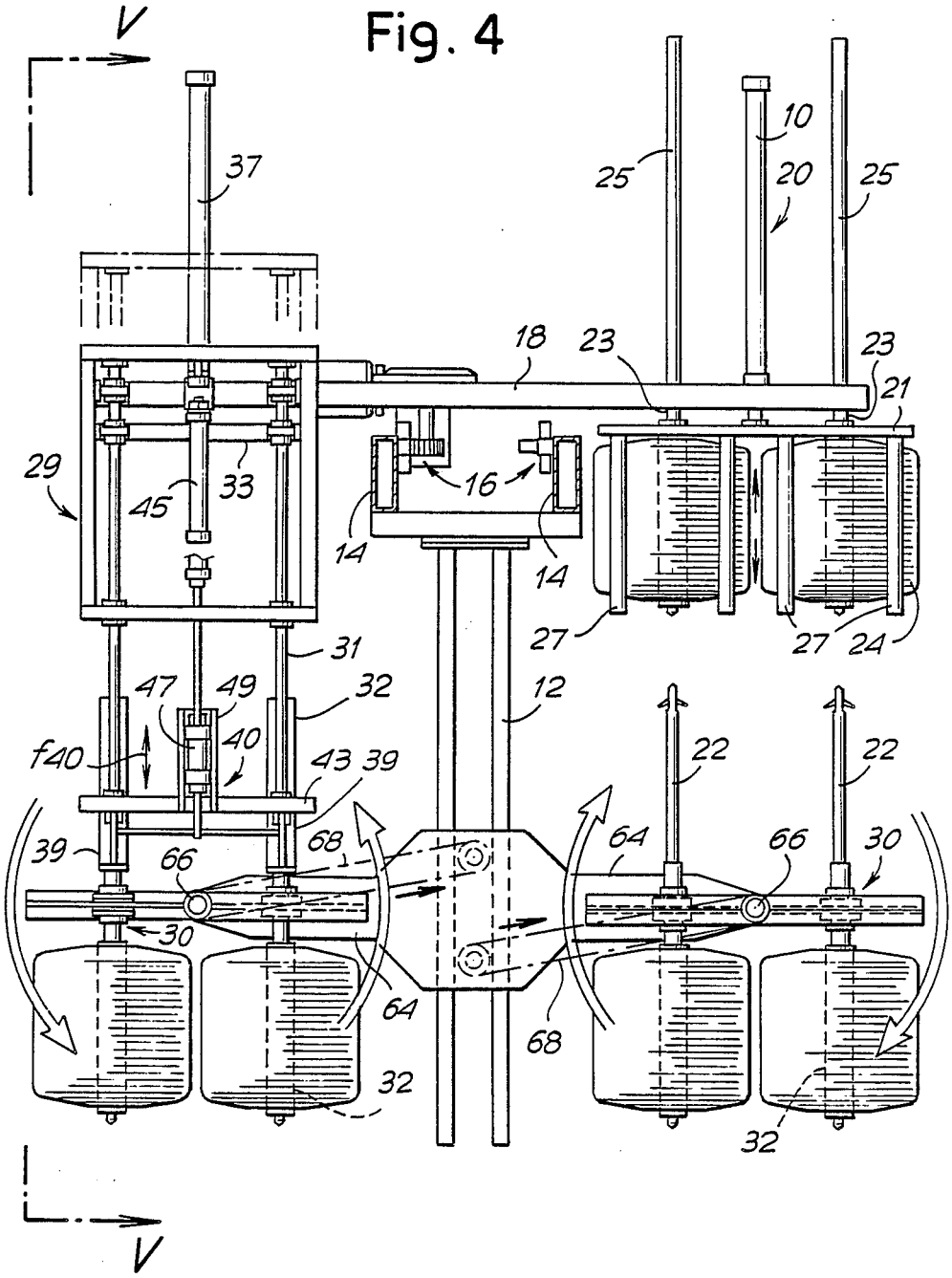
FIG. 4 shows a section of the apparatus for the reels supply to the work groups of a spinner.
Figure 5:
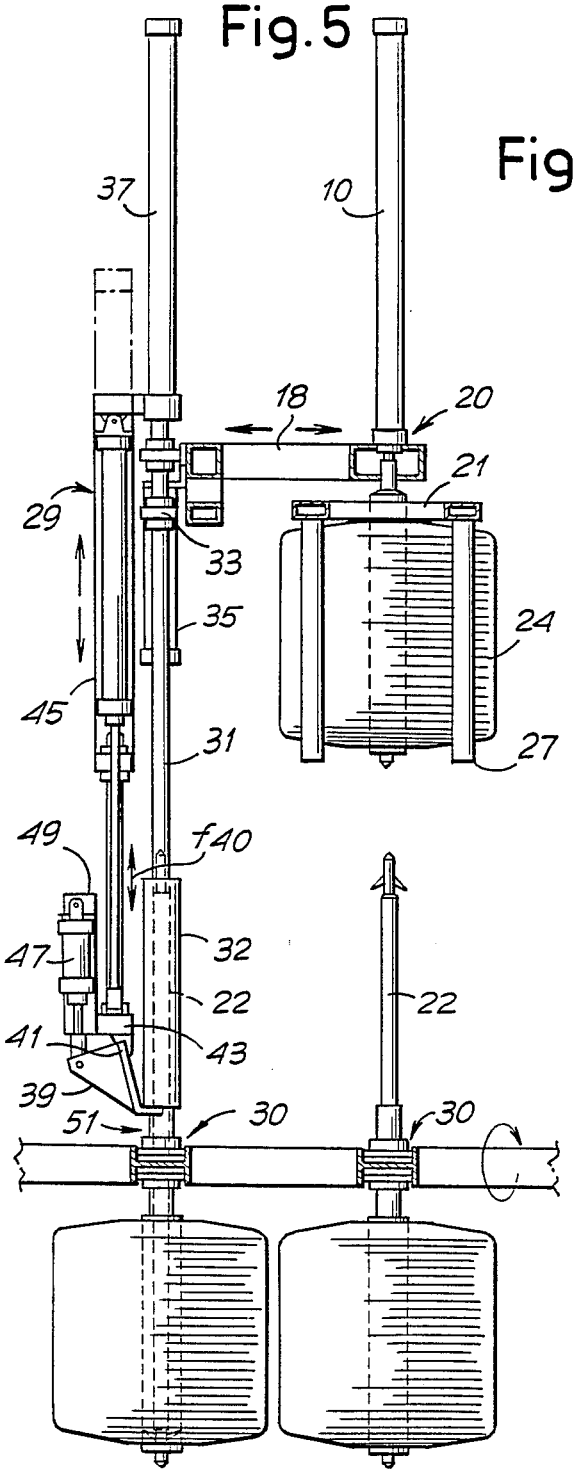
FIG. 5 shows a view on line V—V of FIG. 4.
Figure 6:
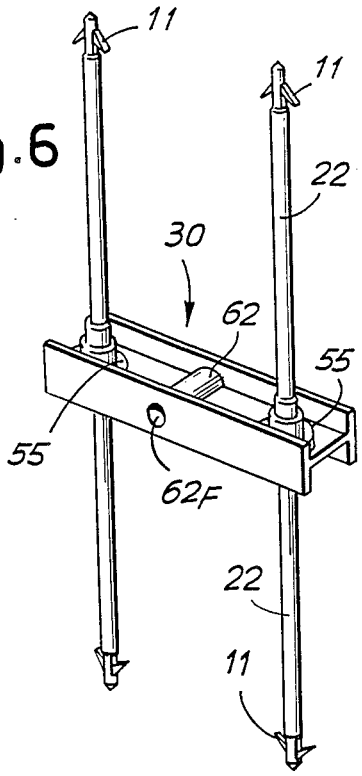
FIG. 6 shows a perspective view of an overturn unit of the apparatus.

FIG. 6 shows the construction, according to the embodiment of the drawing, of a substantially symmetrical overturn unit 30, which consists of a length of double T section; at the centre of the web of the double T a hub 62 is provided having a hole 62F and, at the two ends of said web, the flanged bases 55 are fixed, each being capable of supporting, as above described, a mandrel 22 having the pair of expansion flyers 11, at its end. The unit 30 of FIG. 6 is provided with four mandrels 22 in opposition and coaxially arranged two-by-two. As shown in FIGS. 3, 4 and 5, for each work group 3, the spinner is equipped with an overturn unit 30, from which, during the spinning operation, the full reels 5 project downwards to unreel the material to be spun, same reels being engaged, through their core or tube, with the downwardly turned mandrels 22, owing to the presence of the flyers 11. In the example, each unit 30 is able to support a pair of reels; when these reels have been exhausted (that is, completely reeled off), or when one is reeled off and the other is about to be completely reeled off, the overturn unit 30—which is supposed to have in the meantime received onto the two upwardly turned mandrels 22 two full (supplying) reels 24 handed over by the member 21 of the carriage 18—turns 180° and presents a further pair of full reels to the corresponding work group. Since, as already mentioned, the spinner is symmetrical in respect to a median vertical longitudinal plane, two opposite units 30 are connected to the structure 12 through supporting members 64. The members 64 bear a shaft 66 apt to rotate the units 30 about the axis of hub 62 in the hole of which the shaft 66 is engaged. A centralized drive, housed inside the structure 12, is able to turn each unit 30 every time 180° by the action of chain (or other type) transmission means 68 following a command coming from suitable programming members; as already mentioned, such rotation of a unit 30 gives rise to the presence of two downwardly turned full reels (for the continuation of the spinning) and of two upwardly turned empty tubes.

It should be understood that the overturn units 30, being realized through a length of double T section, make up only an example of a quite simplified and economical construction of transfer members for the mandrels 22. However said units 30 may be—in more complex cases—replaced by equivalent transfer and overturn units exhibiting, in two distinct zones or positions, even more than two downwardly turned mandrels and even more than two upwardly turned mandrels in one or more rows. In such case, also the number of drive systems 20, with members 21, and of assemblies 29 would be consequently changed.

As above mentioned, the carriage 18 has, according to the drawing, only one pair of transversally aligned drive systems 20, as well as a pair of assemblies 29 for the release and withdrawal of the empty tubes 32. Said carriage is moved along guide means 16 in a substantially automated way, with the possibility of being programmed according to the spinner positions in which the reels are to be replaced. To perform an operation, the carriage 18 is moved every time as far as above the carriage containers 9, so as to unload the empty tubes into the container 48 and be able to pick up the reels from the containers 9 and bring the same reels onto the spinner in place of those exhausted (run out of material). The disposition of the grip means 27 of the member 21 is such as to allow the withdrawal of the reels from the carriage containers 9; a disposition may also be provided which allows the alignment of the reels to be picked up in respect to the grip means 27.

When a set of reels at position 5 is completely reeled off or very nearly so, it is necessary to provide for supplying the work groups 3 with new reels; to this end, the carriage 18 is brought together with its reels 24 into alignment above the upwardly turned mandrels 22 of the units 30 of said groups, so as to operate with the transfer systems 20 for lowering the reels 24 and inserting them into these mandrels through the opening of the jaw means 27. Soon after this, the overturn unit 30 is given the command for moving the mandrels 22, with the new reel 24 transferred thereon, from the position with the end 22E turned upwards, to that with said end turned downwards and with the reels 24 in suspended that is work position. By this rotation of the unit 30, the mandrels with the reeled off, or almost reeled off tubes (or cores) 32 are transferred upwards; at this point the carriage 18 is limitedly moved and the withdrawal assemblies 29 are operated to engage the empty tubes and lift them, by clearing the mandrels that are now turned upwards, so as to put them in a condition to receive the reels for a new supply operation. The withdrawal of the empty tubes may be carried out at any time during the delivery of material from the reels being at position 5, and not necessarily just after the replacement of the reels. The picked up empty tubes are suitably moved away during the displacements of the carriage 18, to be stacked up in bulk inside the container 48 and reutilized for further work processes.

Suitable programming systems (timers, electronic limit switches or other) may be provided to establish the run and the position that the carriage 18 has to take up for one replacement of the reels, as well as the rotation of the mandrels with the reels inserted thereon to bring the latter from the upper position to the vertical downwards position, through a call determined by the work groups that are stopped for lack of material or through an operator's manual command. Even if an actual simultaneous running out of all the reels of one or two transverse alignments above the the work groups 3 is not rigidly foreseeable, it is in fact foreseeable that the reels previously replaced, through a simultaneous operation, along one or two transverse alignments, tend all to run out of material at the same moment, thereby the replacement of a set of reels does not necessarily imply a significant loss of spinning material, this material being able to be recovered on a subsequent work process.

FIGS. 11 through 24 show a further development of the embodiment illustrated in FIGS. 3 through 10; common numerals are used for corresponding elements.

Figure 11:
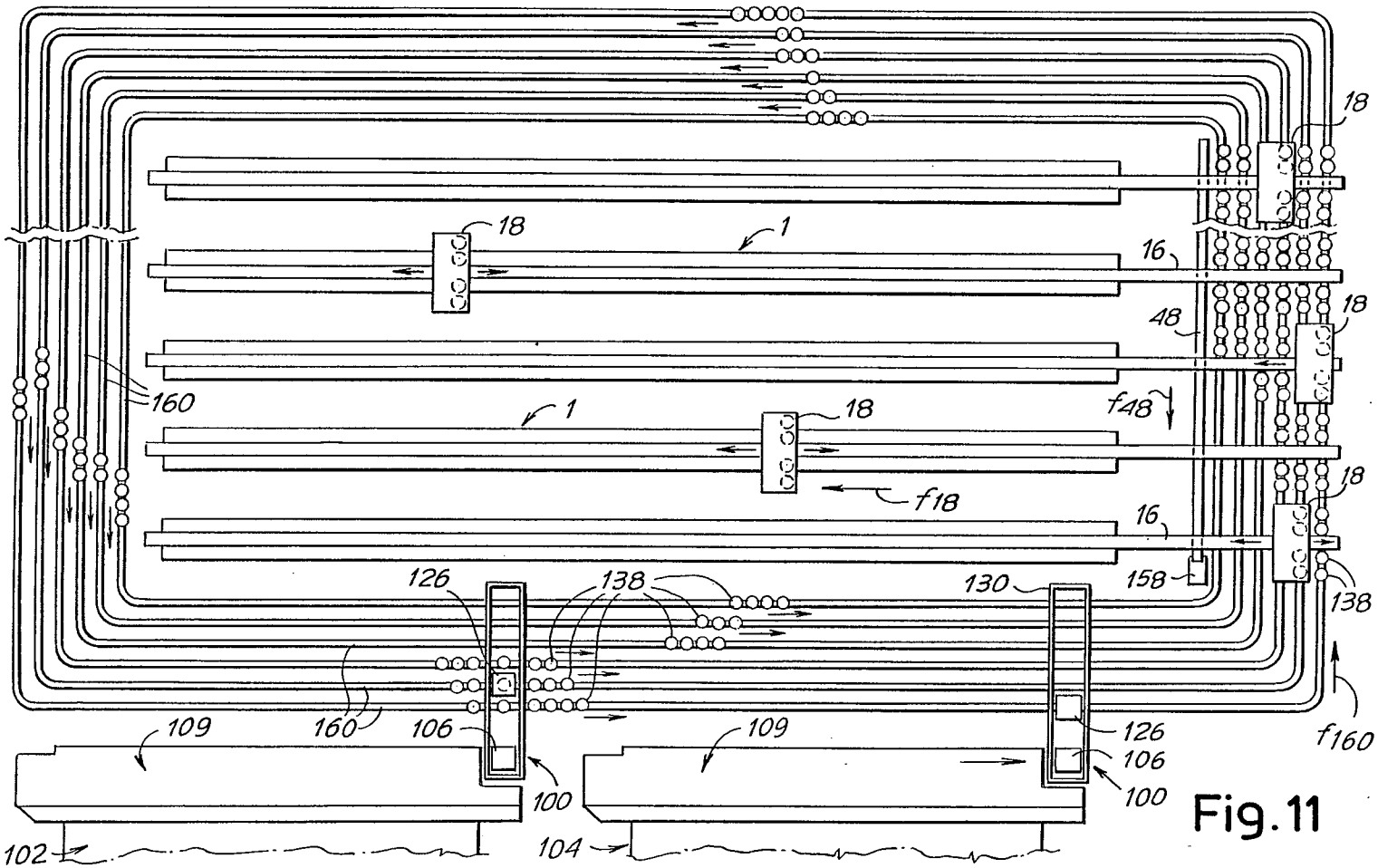
FIG. 11 shows a schematic plan view of a plant for feeding reels to a set of continuous spinners (ring), which plant comprises apparatuses according to the invention.
Figure 12:
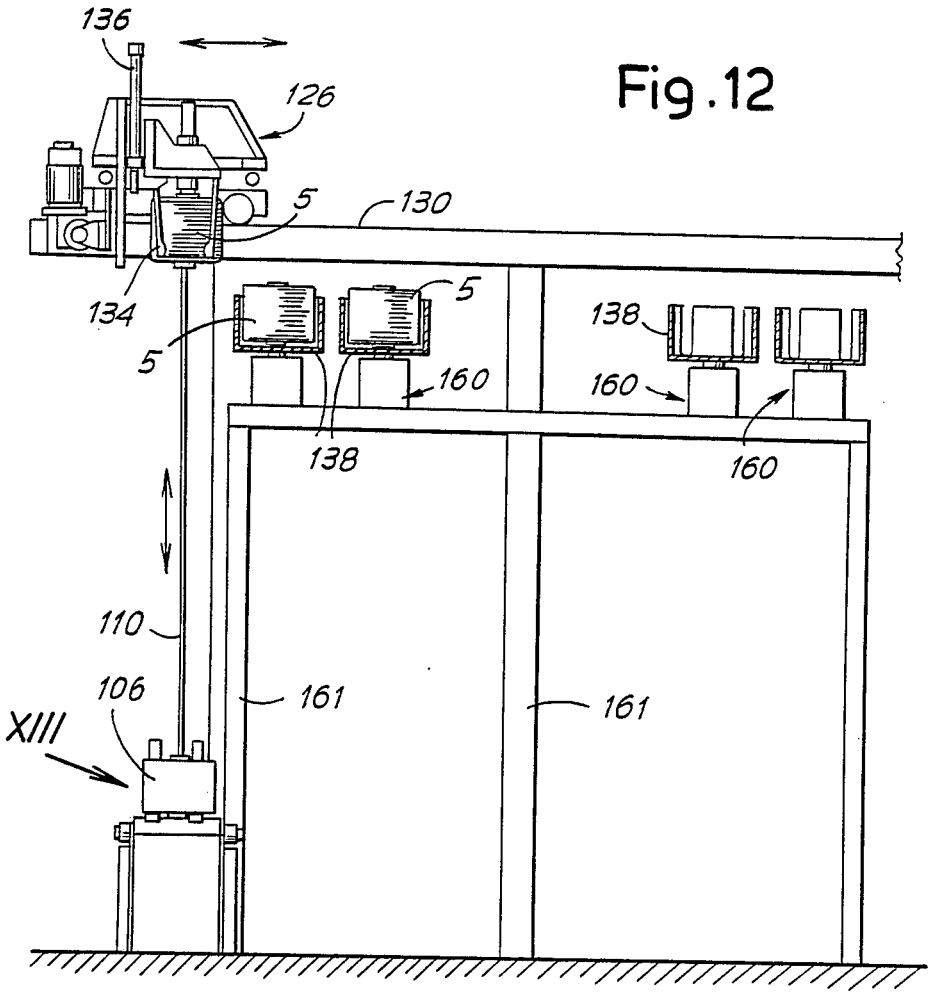
FIG. 12 shows a schematic side view, partly sectioned, of one of said apparatuses.
Figure 13:
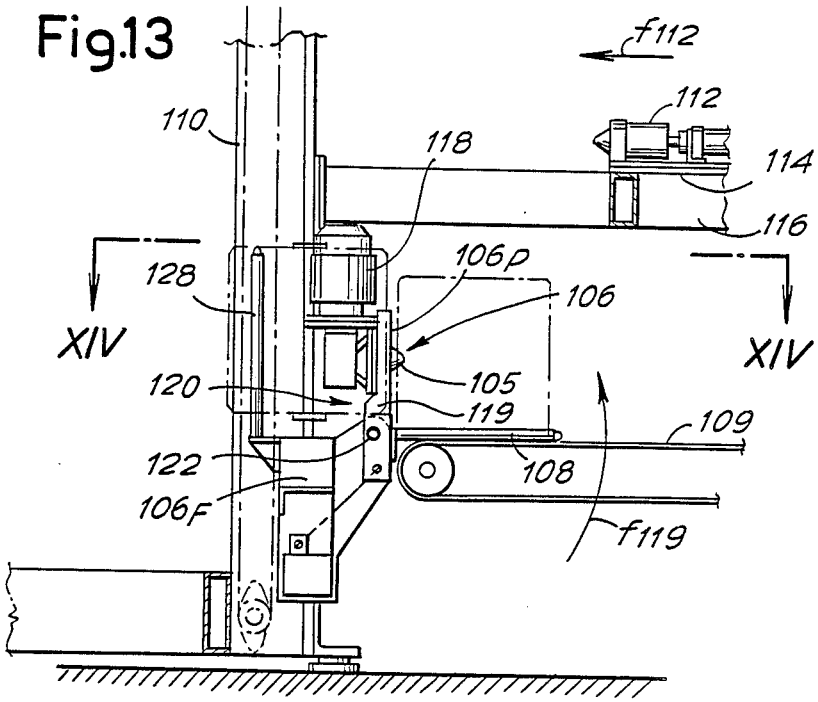
FIG. 13 shows in enlarged view the detail XIII of FIG. 12.
Figure 14:
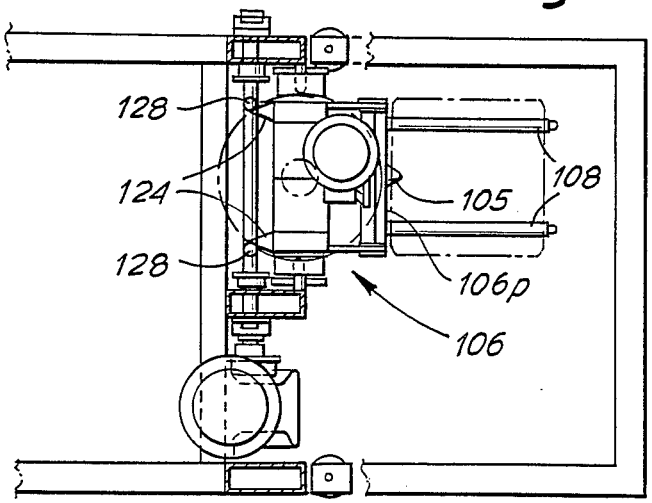
FIG. 14 shows a view on the line XIV—XIV of FIG. 13.
Figure 15:
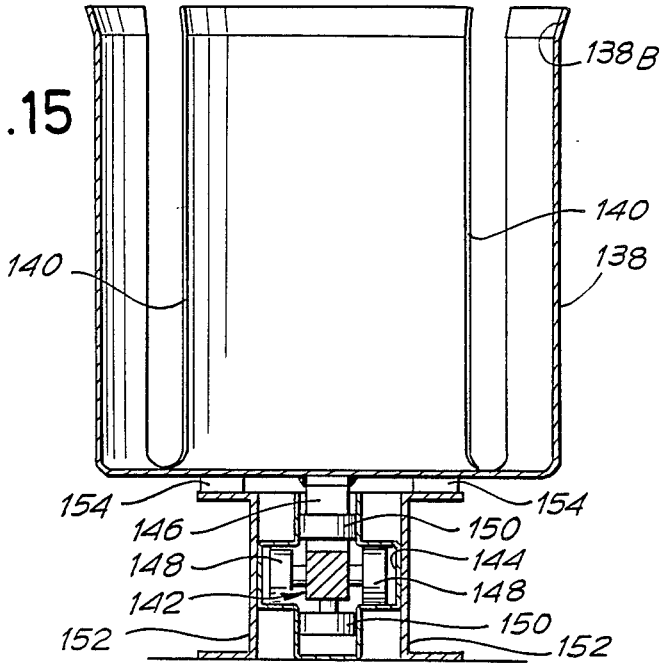
FIGS. 15 and 16 show a section view taken on an axial vertical plane, and a plan view, respectively, of the chain mounted and driven cup conveyors for the transfer of the reels.
Figure 16:
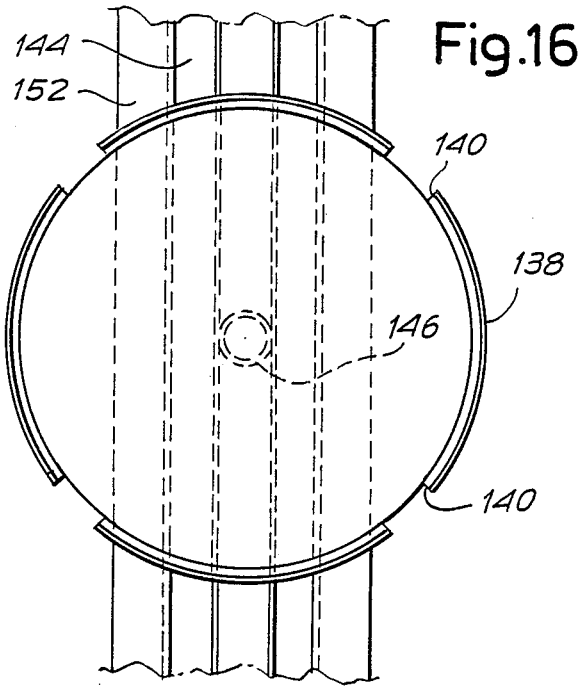

As shown in FIG. 11, the apparatus according to the invention, generally indicated by 100, is intended to supply reels of textile material produced by machines 102 and 104 (called "finishers" or "rubbers") to one or more continuous spinners 1, also named "ring" spinners. In said spinners, the reels 5 must be supported above the work groups 3 for the delivery. The purpose of the apparatus 100 is to provide for the above mentioned supply in a continuous way without labour utilization except for that necessary to control the whole plant. FIGS. 13 and 14 show a carriage unit 106 which receives, at some height from the floor (in the drawing) reels of textile material one at a time from a belt conveyor 109 on which the reels produced by a finisher 102 (or 104) move axially lined up. A pair of rods 108 is provided for receiving and supporting the reel whose horizontal axis finds itself at the level of the axis of a central projection 105 of a plate 106P making part of the unit 106. Accordingly, the projection 105 goes at least partially into the inner hole of the inner core (or tube) of the reel. As a result of a signal—due to a photocell or other—detecting the presence of a reel on the rods 108, the carriage unit 106, which can slide on a vertical rail 110 and comprises chain or rack means for its lifting, raises itself up to an extent sufficient for the axis of the projection 105 to result lined up with the horizontal axis of a tailstock 112 able to rotate inside a sleeve structure which can slide in the direction of arrow f112, and in opposite direction, on guides 114 fixed on a frame 116. Also the elements of the rail 110 are anchored to the frame 116. After such lift, the tailstock 112 is pushed in the direction of the arrow f112 as far as to penetrate inside the hole of the core (or tube) of the reel and then causing it, in turn, to push the reel in contact with the plate 106P. This plate is then put into rotation by a motor reduction gear 118, thereby the reel may perform some revolutions in order "to compact" the outer layer of textile material by making it slide against the rods 108 and causing the free end of the textile "ribbon" (so-called "tail") to penetrate inside the turns to prevent a partial unwinding of the reel. Thereafter, the reel stops its rotation and the tailstock 112 moves back in a direction opposite to arrow f112. As shown in FIG. 13, the unit made up of the rods 108 and of a structure 119 to which said rods are secured and which supports also the motor reduction gear 118 and the members for transmitting the rotation to the plate 106P, said unit 120 constituting the upper part of the carriage 106—is able to perform a 90° rotation about a horizontal axis in the direction of arrow f119, as far as to dispose the rods 108 in the vertical arrangement. Such rotation is obtained by a separate motorization making part of the apparatus 106. When the rods 108 have reached the vertical position, the reel, whose outer layer is now compacted, finds itself (and clamped to a limited degree) between the rods 108 and other two rods 128 which project vertically from brackets 124 secured at the back of the fixed part 106F of the apparatus 106, on which the unit 120 is hinged at 122 for rotation. Once the unit 120 has completed its rotation, the carriage apparatus 106 moves again vertically along the rails 110 until it finds itself (FIG. 12) below a further carriage apparatus 126 predisposed for a horizontal translation on a rail 130 of its own. The apparatus 126, in addition to a motorization able to move it up to a suitable extent along the rail 130, further comprises means for centering and seizing the reel which is presented thereto by the carriage 106 in vertical attitude and placed between the rods 108 and 128. More specifically, a tailstock 132 may be lowered in the vertical direction as far as to go inside the hole of the core (or tube) of the reel, while this is supported by the plate 106P and with the lower hole of said core being engaged by the point 105. Clamping jaw means 134 are made then to intervene being operated by a cylinder-piston system 136, which means seize the reel, keeping it high up, while the carriage 106 may then lower itself along the rail 110 until it takes again the initial position shown in FIG. 13 at which it can receive again one successive reel from the belt conveyor 109. As shown in FIG. 12, the carriage apparatus 126, whose jaws hold now a reel 5, moves along the horizontal rail 130, just to an extent needed for the axis of said reel to result lined up with the axis of a "cup", that is, a cylindrical vertical upwardly opened container indicated by 138. The set of jwas 134 can be vertically lowered, driven by a suitable cylinder-piston or other system, and is then able to place the reel 5 inside the cup 138. The latter, whose characteristics are better illustrated in FIGS. 15 and 16, has an inviation, that is, a flared edge 138B and slots 140 as well, on the holding cylindrical wall, for the passage of the jaws 134 during the lowering thereof, and for the opening, and the subsequent lifting thereof. The cup 138 makes part of a plurality of cups of identical type, which are fixed, in order to result normally equidistant, with their axes vertically disposed and their opening upwardly turned, to a continuous conveyance chain 142.

The conveyance chain 142 (FIGS. 15 and 16) is a chain having cross-shaped links which slide within a tubular channel 144 whose cross-section is also Greek cross-shaped, with the turned upwards cross arm opened for the passage of a shank 146 fixed at the centre of the bottom of each cup 138. The links of the chain 142 slide inside the channel 144 supported and guided by two pairs of rolls 148, having horizontal a axis, and 150, having a vertical axis, respectively for the support and the guide thereof. In the example of the drawing, the channel 144 is disposed between the central vertical parts of two C sections 152, opposite to each other, that is, with the flanges turned outwardly. Above the upper flanges of the sections 152, pads 154 welded at the bottom of each cup 138 are provided for slidingly supporting the cup as this moves dragged along by the chain 142.

In a plant such as that illustrated in FIG. 11, one or more apparatuses 100 according to the invention (two in the example of the drawing) continuously feed - by transferring into successive cups 138 one reel at a time one or more conveyance lines 160 formed by respective chains 142 and channels 144, said lines exhibiting a continuous array of upwards turned cups 138 suitably spaced apart. The lines 160 are supported at a suitable height by portal frames 161 (FIG. 12), and are closed to form a ring with the relative chains 142 moving step-by-step in the direction of the arrow f160 so that the cups 138, that have received and hold a reel, move towards a side of the ring located at some distance from the head of the spinner(s) 1 and perpendicular to the spinner's axis. According to a logic disposition, the axes of the spinners are parallel to each other and perpendicular to said side of the ring, in correspondence of which, the lines 160 are parallel to each other and mostly equidistant. As schematically illustrated in FIGS. 17 and 18, in order to feed each spinner 1, a carriage 18 is provided, able to pick up the full reels from the cups 138 and transfer them to the work groups 3 of the spinner, after having withdrawn the empty tubes of the reeled off reels in order to discharge them onto the belt conveyor 48; the belt conveyor 48, of limited width and located at some height, moves transversally to the axis of the spinner(s) in the direction of the arrow f48 and dump the empty tubes in bulk into a container 158 or into different containers tidily arranged according to their colour by suitable detection and selection means. The or each spinner 1, in turn, comprises a central mounting 12, with longitudinal beams 14 supporting extended guide means 16 for the carriage 18, which is thus able to be moved along the spinner 1 and reach a predetermined conveyance line 160 for the withdrawal of the reels with which to feed the spinner. The carriage 18 is so structured as to project from opposite sides in respect to the rows of the work groups 3 of the spinner.

Each carriage 18 has (FIG. 19) one or more drive system 20, equipped with members 21, to determine an axial vertical movement of reels (two pairs in the example of the drawing) which it withdraws from cups 138 of a conveyance line 160 and then hands over, after a suitable translation in the direction of the arrow f18, to mandrels 22 of suitable overturning members 30 with which each work group 3 is provided. The mandrels 22 are intended to receive the reels to be replaced and, after their overturning, to keep them hanging downwards for the regular unwinding of the rove during the spinning operation.

The drive system 20 is made up (in the drawing) of a cylinder-piston system 10 at the rod of which a transverse member 21 is fixed, which is provided with guide rods 23 sliding within tubular guides 25. The member 21 has jaw means 27 in its lower part articulated thereto and driven by fluid means (or in other way), said jaw means being able to withdraw the reels from the cup containers 138 and open up to release them once their core (or tube) 32 has slipped, owing to the lowering of the member 21, onto an upwardly turned mandrel 22 of an overturning member 30. The downwards run of the member 21 is that needed for properly withdrawing a reel from an underlying cup 138 whose axis is coincident with that of a member 21. It will be appreciated that the pitch (or distance) according to which the cups 138 are arranged on each conveyance line 160, and the step-by-step advancement movement of the respective chain 142, must be such as to ensure a set of four reels-holding cups 138 (in the example of the drawing) to find itself under a carriage 18, each of said cups having its axis coincident with that of the respective gripping and lifting member 21 located on the carriage 18. Clearly, it is possible that an intermediate cup find itself in the interspace between two pairs of cups located under the carriage for the withdrawal of the reels, and that such intermediate cup, since it remains filled with material, will not be fed afterwards by the apparatus 100, while the relative withdrawal of the reel held therein may be subsequently provided according to the schedules program for the whole plant. Otherwise, the cups 138 will result spaced out, on the chain 142, for example every set of four, by a missing cup between one set and another; this in case of carriages 18 predisposed according to the example of the drawing. Since the supply of the work groups 3 takes place "on call", that is when the unwinding reels are reeled off or almost reeled off, it is also possible that a cup 138 containing a reel, of a line 160, goes beyond the axis of a spinner, without the withdrawal by carriage 18 of the reels as these are not needed for the work accomplishment. But, it will be apparent that the lines 160, besides constituting, owing to their significant development and the ring-like closing up, a means for the transfer of the reels from the positions in which they receive them by the appartuses 100, they also make up a store of reels ready to be used in the or in a spinner. This store, advantageously, does not become cumbersome in a spinning department as it is fully overhead. It also results of large capacity when the lines 160 are many, and may also receive and hold, separately on each line, reels of more than one type of textile material. For example, in the case of the plant shown in FIG. 11, a first finisher 102 (on the left in the drawing) may produce reels of a first type of rove, while the second 104 (on the right in the drawing) may produce reels of a second type of rove, and half the lines 160 of the drawing may be fed with the reels produced by the first finisher, the other half receiving instead those produced by the second. And also one half the number of spinners 1 shown in FIG. 11 may work with the reels coming from the first finisher, and the other half with those coming from the second. All this may be easily accomplished through suitable computerized programming devices able to co-ordinate the movements and the operations both of the carriages 126 of the apparatuses 100, by co-ordinating them with the displacements of chains 142, and those of carriages 18 predisposed for the supply of each spinner 1, whose operations must, in turn, be co-ordinated with the situation of the various work groups 3.

One of the main advantages of the plant of FIG. 11, equipped with the apparatuses 100 and with a set of conveyance lines 160, lies in the fact that the finishers, or rubbers, 102 and 104 may, to a certain degree, work in a continuous manner, independently of the material-absorption capacity of the spinners; and in addition to the fact that, in case of stoppage of either or both the finishers, the spinners 1 may keep on working by utilizing the surplus reels stored in the cups of the lines 160. A further very important advantage lies in the fact that while in the prior art the reels coming out from the finishers were manually, or by suitable equipment, placed inside carriage containers, from which they were then withdrawn by the carriage 18 of each spinner, these carriages, which were very cumbersome and demanded considerable labour intervention for handling them correctly and promptly are now fully eliminated. It should be appreciated that, according to the above mentioned arrangement of the reels in the carriages, the production capability of the finishers was then limited by the number of available carriages, which could not obviously be too high owing to the limited space available.

FIGS. 19 through 21 show the ways according to which the full reels, picked up by the cup containers 138, are handled as far as to be disposed on a delivery attitude, that is, suspended and turned downwards, as well as the necessary handling of the empty cores (or tubes) 32 of the now reeled off reels. Mention has already been made of members 21 of each carriage 18 for the withdrawal of the reels from the cups 138 and the release of them so that the core internal thereto may be inserted on the upwards turned mandrels 22 of the overturning members 30 of the work groups 3 of the spinner: the mandrels 22 are intended to receive the reels to be replaced and, after the overturning, to keep them in delivery attitude.

As shown in FIG. 22, each mandrel 22, on which a tube 32 may be inserted for rotating solid thereto, has at the end 22E (of reduced diameter) a pair of expansion flyers 11, articulated at 15 and kept spaced apart by a helical spring 13, which flyers retain the tube 32 and the reel wound thereon, when the mandrel, by means of a member 30, finds itself turned, that is overturned downwards in work position. The flyers 11, in their normal expansion position, also prevent the exit of a tube 32 which is to be picked up by a mandrel 22, after the reel, of which the tube formed the support, has been reeled off and after the mandrel 22 of such reel has reached an upwardly turned vertical position by means of the respective overturning member 30. The carriage 18 is equipped with assemblies 29 (two in the example of the drawing) for the release and the withdrawal of the empty tubes 32 from the mandrels 22. The assemblies 29 provide for the withdrawal of empty tubes when the carriage 18 is above the overturning member of a work group, for the retention of them during the carriage displacement up to a position overhanging the belt conveyor 48 and for the dropping of them onto the latter. Each assembly 29 comprises tubular rods 31, whose inner diameter is more or less equal to that of the end 22E (of reduced diameter) of the mandrel 22, from which the flyers 11 project; the outer diameter of the tubular rods 31 is almost equal to that of the rod of mandrel 22. The tubular rods 31 are in a vertical position and, when the carriage 18 is at the position for the withdrawal of the empty tubes, are coaxial with the underlying mandrels 22. The rods 31 are secured to a unit 33, sliding within the guides of a frame 35; a cylinder-piston system 37 pushes the unit 33 downwards, so that the end of each tubular rod 31 can fit the end 22E of each mandrel 22 thus causing the "disappearance" of the flyers 11, which occurs by the action of the counteracting spring 13. When the rods 31 have engaged the ends 22E of the mandrels 22, a continuity condition actually occurs between the surfaces of the rods and of the mandrels so that the withdrawal of the empty tubes 32 is possible. In oder to perform such withdrawal, each assembly 29 is equipped with jaw members 39 articulated at 41 to a beam 43 of a unit 40, which is vertically movable upwards and downwards according to the arrow f40 by means of a cylinder-piston system 45. To pick up the tubes after the lowering maneuver, the jaw members 39 are moved to their closing position as shown in FIG. 20, by means of a cylinder-piston system 47 secured to an appendix 49 which projects upwards starting from the center of the beam 43. The flat gripping portion of each jaw means 39 is made to enter, in order to seize a tube 32, the space 51 which, on the usage conditions, is present between the lower end of a tube 32 and a hub 53 of a flanged base 55 within which the thrust and support bearing is housed for the rotation of each mandrel 22 (FIG. 22).

FIG. 22 shows the simple and economical construction of a substantially symmetrical overturning member 30, which consists of a double T section; at the center of the section web a hub 62 is formed having a hole 62F and at the two ends of said web, flanged bases 55 are fixed each being able to support, as above mentioned, a mandrel 22 having the pair of expansion fyers 11 at its ends. The member 30 of FIG. 21 is provided with four mandrels 22, coaxially and oppositely arranged two-by-two. As shown in FIGS. 18, 19 and 20, for each work group 3 a spinner 1 is equipped with an overturning member 30, from which, during the spinning operation, the full reels project downwards at position 5 from which the material to be spun is delivered, said reels being engaged, through their core, or tube, with the downwardly turned mandrels 22, owing to the presence of the flyers 11. In the example of the drawing, each member 30 is able to support a pair of unwinding reels, and, in opposite position, a pair of mandrels; when these reels have been reeled off, or one is reeled off and the other is almost reeled off, the overturning member 30, which is assumed to have received in the meantime, on the two upwards turned mandrels 22, two full reels (for supply) handed over by the member 21 of the carriage 18, rotates through 180° and presents to the corresponding work group a further pair of full reels. Since the spinner or each spinner is symmetrical in respect to a median vertical longitudinal plane, two facing members 30 are connected, through support elements 64, to the structure 12. The elements 64 support a shaft 66 able to rotate the members 30 around the axis of the hub 62 in the hole of which the shaft 66 is engaged. A centralized control, housed within the structure 12 is able to rotate each member 30, by a command coming from the programming devices, every time through 180°, by means of chain (or other) drive means 68; as already mentioned, such rotation of one member 30 gives rise to the presence of two full reels turned downwards (for the continuation of the spinning) and of two cores or empty tubes turned upwards (in order to be picked up and moved by the carriage 18 onto the belt conveyor 48).

Obviously, the carriages 18, their members for the withdrawal and release respectively of the full reels and of the empty tubes, as well as the overturning groups 30 of the work groups of the spinners, shall have, in a plant like that schematically depicted in FIG. 21, uniform features for each spinner; moreover, the carriages 18 must be designed according to the pitch, that is, distance at wich the cups 138 are disposed on the conveyance lines 160 and also according to their height.

In other words, a plant like that schematically represented in FIG. 11 is designed as a unit and provided with programming means able to give rise to a regular, perfectly co-ordinated operation. By these criteria which, however, make part of the technical expertise of those skilled in the art, it is possible to construct a fully automated plant which can be run almost entirely without labour.

It is understood that the drawing shows only an exemplification given only as a practical demonstration of the invention, as this may vary in the forms and dispositions without, nevertheless, coming out from the scope of the idea on which the invention itself is based.

I claim:

1. Apparatus for supplying continuous spinning machines with reels or bobbins of reeled material comprising:

a frame or housing (12; 212) extending along and above the spinning machine (1; 201), supporting guide means (16; 216), including a transfer carriage (18; 218) running along said spinning machine;

said transfer carriage having a plurality of mandrels (22, 222) carrying reels or bobbins (24; 224) to be replaced, drive means (20; 220) being provided to lift and lower said mandrels, and jaw means (27) being provided in order to engage and retain the reels or bobbins inserted on said mandrels; and comprising in cooperative relationship with each or with a set of working groups (3; 203) an overturn and transfer unit (30; 230) carrying a plurality of mandrels (22; 222A), a first set of which is directed downwardly in order to maintain a corresponding set of reels in the feeding portion, suspended above the corresponding working groups, and a secnd set of which is directed upwardly in order to receive a set of new reels or bobbins, means (68, 233, 234, 230) being provided in order to move said unit so as to substitute exhausted or partially exhausted reels with new reels, said mandrels carried by said unit being provided with elastic elements (11) adapted to retain the tubes (32) and the reels wound thereon on the corresponding mandrel.

2. Apparatus according to claim 1, wherein said transfer carriage (18; 218) further comprises an assembly (29) having jaws (39) for the withdrawal of exhausted tubes (32) from the upwardly directed mandrels (22) of said unit (30), and rods (31) for the disengagement of said tubes from said mandrels, means (37, 45) being provided for the lifting and lowering of said jaws and said rods.

3. Apparatus according to claim 2, wherein said elastic elements comprise flyers (11) disposed at the end of said mandrels (22), capable of being retracted; and wherein said rods (31) for the disengagement of the tube (32) from a mandrel are each made up of a tubular rod fixed to a member of the transfer carriage, which rod lowers down to fit on said end thus causing the retraction of said flyers against the action of the elastic means, and the exhausted tube being inserted on the tubular rod by means of said jaw (39), which grips said tube sideways and underneath.

4. Apparatus according to claim 2, wherein said transfer carriage (18) comprises: a first section comprising said mandrels for carrying reels to be replaced, said drive means (20) for lifting and lowering said mandrels, and said jaw means (27) for the retention of the reels; and a second section comprising said assembly (29) for the withdrawal of exhausted tubes (32) and said rods (31) for the disengagement of said tubes from the relevant mandrel (22).

5. Apparatus according to claim 2, further comprising:

carriage means (106) vertically slidable from a lower position to an upper position;

said carriage means including a first pair of bars (108) and a unit (119), said bars (108) being mounted on said unit (119) and adapted to take a horizontal and a vertical position, and also adapted to receive the reels fed by a belt conveyor (109) disposed in cooperative relationship with the lower position of said carriage means, the reels being axially mounted and disposed with the axis thereof parallel to the advancement direction of said conveyor belt;

means (105, 112) for rotating the reel in order to compact the outer layer of the latter and entrap the end of the last turn by causing said layer to slide in contact with said bars (108);

a pair of vertically disposed bars (128) forming, in combination with said first pair of bars (108), a retention seat for said reels;

a horizontal rail (130) supporting a carriage (126) disposed cooperatively with respect to upper position of said carriage means (106) and movable along said horizontal rail and provided with centering means and vertically moving clamping jaw means (134) adapted to withdraw a vertically disposed reel; and disposed perpendicularly with respect to the horizontal rail (130), a chain conveyor (160) having seats (138) for receiving said reels transferred by said carriage (126) for horizontal translation, said seats (138) being disposed at such a height and in such a manner as to be capable of being picked up by a transfer carriage (18).

6. Apparatus according to claim 5, wherein said means for rotating the reel on said vertically movable carriage comprises a tailstock (112) and a centering point (105), said tailstock and said centering point entering the opposite ends of the mandrel of the reel to be rotated, and said tailstock being axially movable to and away from said point.

7. Apparatus according to claim 5, including at least one spinning machine wherein said conveyor (160) forms a closed polygonal line disposed around said at least one spinning machine characterized by spinning axes, said horizontally translating carriage (126) moving perpendicular to a side of said line and the spinning machines axes being perpendicular to another side of said line.

8. Apparatus according to claim 7, wherein said closed polygonal line has a rectangular shape.

9. Apparatus according to claim 7, further comprising a plurality of conveyors (160) concentrically disposed around a set of spinning machines having longitudinal axes parallel to each other and perpendicular to a predetermined side of said conveyors.

10. Apparatus according to claim 5, including a cross-shaped tubular channel (144) for supporting said conveyor (160), said conveyor being in the form of a chain having cross-shaped links, which links are guided in and supported by said cross-shaped channel (144).

11. Apparatus according to claim 1, including a carriage container (9; 209) and further comprising on at least one end of the spinning machine a withdrawal station for the withdrawal of reels or bobbins from said carriage container (9; 209), means being provided for transferring the reels from said carriage container to the mandrels of the transfer carriage (18; 218).

12. Apparatus according to claim 11, further comprising programming means provided for the positioning of the transfer carriage for the engagement of the reels to be picked up, the mandrels on said transfer carriage being coaxially disposed with respect to the reels loaded in the carriage container (9; 209), said programming means defining the lowering and the lifting of the mandrels and/or of the bottom of the carriage container.

13. Apparatus according to claim 11, further comprising, on at least one end of the spinning machine, a container (48; 248) for the collection of exhausted tubes.

14. Apparatus according to claim 1, wherein each of said overturn and transfer units (30) comprises a beam which supports four mandrels symmetrically and oppositely disposed two-by-two and projecting perpendicularly to said beam, a hub (66) being disposed at said beam's center for rotation of the unit (30) by rotation means, the axis of said hub being perpendicular to the plane on which the axes of said mandrels lie.

15. Apparatus according to claim 14, wherein said beam of said overturn and transfer units (30) has a double T section, the hub and the bearing for the mandrels being disposed on the web of the double T.

16. Apparatus according to claim 14, wherein said overturn and transfer units (30) comprise two opposite overturn and transfer units (30) and wherein the rotation means comprise a single central motorization means.

* * * * *